United States Patent [19]

Dassé

[11] Patent Number: 4,877,466

[45] Date of Patent: Oct. 31, 1989

[54] PERCUSSION-SENSITIVE THERMOSTABLE PYROTECHNIC COMPOUND

[75] Inventor: Gérard Dassé, Tarbes, France

[73] Assignee: Etat Francais as represented by the Delegue general pour l'armement, France

[21] Appl. No.: 292,247

[22] Filed: Dec. 30, 1988

[30] Foreign Application Priority Data

Dec. 3, 1987 [FR] France ..... 87 16762

[51] Int. Cl.[4] ..... D03D 23/00

[52] U.S. Cl. ..... 149/108.6

[58] Field of Search ..... 149/108.6

[56] References Cited

U.S. PATENT DOCUMENTS

| | | | |
|---|---|---|---|
| 1,999,820 | 4/1935 | Nash | 149/108.6 |
| 2,461,544 | 2/1949 | Hole et al. | 149/108.6 |
| 2,867,517 | 1/1959 | Zebree | 149/108.6 |
| 3,498,858 | 3/1970 | Aker | 149/108.6 |
| 3,895,577 | 7/1975 | Zebree | 102/275.5 |
| 3,956,038 | 5/1976 | Duguet et al. | 149/4 |
| 3,971,319 | 7/1976 | Larson | 102/204 |
| 4,329,924 | 5/1982 | Lagofin | 102/202.8 |
| 4,566,921 | 1/1986 | Duguet | 149/22 |

*Primary Examiner*—Edward A. Miller

*Attorney, Agent, or Firm*—Arnold, White & Durkee

[57] ABSTRACT

The invention relates to the field of percussion-sensitive thermostable pyrotechnic compounds. It includes a mixture of a primary explosive and a powder of selenium and/or sulfur. The primary explosive is taken from the group of metallic nitrides and constitutes 80 to 99% of the compound by weight. The selenium and/or sulfur powder constitutes 1 to 20% by weight. The grain size of the selenium and/or sulfur powder is between 2 and 250 μm. The compound includes 95% silver nitride by weight and 5% selenium, or 85% silver nitride by weight and 15% sulfur.

For application as a percussion-sensitive primer.

5 Claims, No Drawings

PERCUSSION-SENSITIVE THERMOSTABLE PYROTECHNIC COMPOUND

BACKGROUND OF THE INVENTION

1. Field of the Invention

This invention relates to the field of percussion-sensitive thermostable pyrotechnic compounds such as those used in primers.

2. Description of the Prior Art

In the current state of the art, it is well known that sensitive compounds are used to initiate detonation relays. These compounds are made of metallic nitrides, to which a sensitizing agent is added such as tetrazene or diazodinitrophenol, which are organic products. Roughly speaking, they may include 95% lead nitride by weight and 5% tetrazene. The main disadvantage of these compounds resides in the instability of the sensitizing agent when the primers are used in severe environments, at temperature above 70 ° C., as this is close to the tetrazene decompound temperature, which is about 70° C.

The French patent No. A 2 386 505 is known, in which it is proposed to solve this problem by varying the grain size of the tetrazene to increase its decompound temperature. However, the problem is not fully solved because of the hazards inherent in its manufacture.

Ternary pyrotechnic compounds of the lead thiocyanate, potassium chlorate and antimony sulfide type are known that are stable at a temperature of 90° C. However, these are sensitive to moisture and have no detonating power.

The present invention therefore relates to a new percussion-sensitive primer compound including a new class of sensitizers that do not exhibit the disadvantages of low thermal stability.

SUMMARY OF THE INVENTION

In brief, the invention is a pyrotechnic compound that is stable at a temperature of the order of 100° C., sensitive to percussion, having an initiation power, and including a primary explosive cponsisting of silver nitride and a powder of selenium, tellurium and/or sulfur.

The primary explosive may be apportioned at 50 to 99% by weight, and the powder at 1 to 50% by weight.

DESCRIPTION OF THE PREFERRED EMBODIMENTS

First Embodiment

According to one preferred embodiment of the invention, the compound includes 95% silver nitride by weight and 5% selenium.

Second Embodiment

According to another preferred embodiment, the compound includes 85% silver nitride by weight and 15% sulfur.

The grain size of the selenium, tellurium and/or sulfur is advantageously set between two and 250 μm.

One result of the invention resides in the fact that the detonation compound can be used at a temperature of the order of 100° C. without altering its percussion sensitivity significantly.

Another advantage resides in the surprising sensitivity of the detonation compound, which remains of the same order of magnitude as that of the classical tetrazene-base compositions.

Another advantage resides in the ease with which the process of preparing the detonation compounds is implemented.

Still another advantage resides in the low hygroscopicity of the resulting detonation compounds.

The examples given below illustrate the embodiment of the invention in greater detail.

The powders of selenium, sulfur and tellurium are sensitizing agents of the explosive and are used pure, alone or in a mixture, and are capable of sensitizing the primary explosive without degrading its detonating power, by their physical and chemical properties.

The reaction mechanism has not been entirely clarified but the results seem to show that the initial reaction involves the cation of the primary explosive and the constituent element of the powder, normally neutral, resulting in a sensitization of this explosive.

In all cases, the following process is used. The nitride and sensitizer are placed in a rotary mixture used for pyrotechnic compounds and equipped with adequate safety devices. After the mixture is homogenized, the primer cells are filled directly.

The following two compounds have been prepared according to the above procedures:

Example 1: 85% silver nitride and 15% sulfur (percent by weight)

Example 2: 95% silver nitride and 5% selenium.

Various tests have been carried out to evaluate the detonation compounds according to the invention and, in particular, their sensitivity to impact was measured along with their detonating power, relative to a classical reference compound including 95% lead nitride by weight and 5% tetrazene.

Impact Sensitivity

A certain number of detonator primers were prepared, at a rate of 45 mg per cell. These primers and the reference underwent the following treatments:

Series 1: control group (no environmental test)

Series 2: storage at 75° C. for ten days

Series 3: storage at 95° C. for eight days

Series 4: storage at 95° C. for thirty days

Series 5: storage at 95° C. for two months

Series 6: ten climatic cycles of 36 hours. The climatic cycle included a twelve-hour period at 74° C., then a temperature rise to 100° C. over a two-hour interval, followed by four hours at this temperature, then a reduction to 54° C. in one hour's time, to stay 14 hours at this temperature, then a temperature rise to +74° C. in three hours.

By comparison, the reference primers are charged with a mixture of lead nitride and 5% tetrazene by weight. After these tests, the percussion sensitivity is determined according to the known procedure in this technical field, by the dropping of a 3.2 g ball.

The sensitivities are expressed in the form of the height from which the ball is dropped, in millimeters, that corresponds to a probability of operation of 0.5.

The results are brought together in the following table:

| Compound | Series 1 | Series 2 | Series 3 | Series 4 | Series 5 | Series 6 |
|---|---|---|---|---|---|---|
| Example 1 | 70 | 200 | — | — | — | 140 |
| Example 2 | 75 | 80 | 150 | 150 | 230 | — |

-continued

| Compound | Series 1 | Series 2 | Series 3 | Series 4 | Series 5 | Series 6 |
|---|---|---|---|---|---|---|
| Reference | 150 | >500 | — | — | — | >500 |

These results show that the compounds according to the invention are more percussion-sensitive and temperature-stable in temperature than the classical compounds. Roughly speaking, it will be noticed that the sensitivity of the primary explosive used corresponds to heights of more than 900 mm.

Initiation Power

The initiation power was evaluated by drilling through steel disks according to the known "gap test" method. The compound to be tested is loaded into a cell having an inside diameter of 3.8 mm. A relay of 50 mg of secondary explosive, a variable-thickness steel barrier and the detonator primer to be tested are introduced in order in a steel sleeve. A perforation made made of AU4G is placed at the end of the steel sleeve.

The test consists of determining the thickness of the steel barrier which prevents the secondary explosive from detonating and thereby not perforating the steel barrier. The barrier thicknesses allowed by the tested compounds are the following.

Examples 1 and 2: 0.8 mm

Reference: 0.4 mm

These results show that the compounds according to the invention have an initiation power greater that that of the classical reference compound.

The tests carried out with the sulfur or selenium replaced by tellurium yield results of the same order of magnitude, as concerns sensitivity and detonating power. Moreover, increasing the percentage of powder decreases the initiation performance. However, these compounds maintain an initiation power and a percussion sensitivity.

What is claimed is:

1. Pyrotechnic compound that is stable at temperatures of the order of 100° C., percussion-sensitive, having an initiation power, wherein it includes a mixture of a primary explosive consisting of silver nitride and a powder of selenium, tellurium and/or sulfur.

2. The compound of claim 1, wherein the primary explosive is apportioned at 50% to 99% by weight and the powder at 1% to 50% by weight.

3. The compound of claim 2, wherein it includes 95% silver nitride by weight and 5% selenium by weight.

4. The compound of claim 2, wherein it includes 95% silver nitride by weight and 15% sulfur by weight.

5. The compound of any of the preceding claims, wherein the grain size of the powder of selenium, tellurium and/or sulfur is between two and 250 μm.

* * * * *